US007893664B2

(12) United States Patent
Chiang

(10) Patent No.: US 7,893,664 B2
(45) Date of Patent: Feb. 22, 2011

(54) POWER CONSUMPTION REDUCTION OF A POWER SUPPLY

(75) Inventor: Yun-Chi Chiang, Zhubei (TW)

(73) Assignee: Richtek Technology Corp., Hsinchu (TW)

( * ) Notice: Subject to any disclaimer, the term of this patent is extended or adjusted under 35 U.S.C. 154(b) by 145 days.

(21) Appl. No.: 12/289,410

(22) Filed: Oct. 28, 2008

(65) Prior Publication Data

US 2009/0115501 A1 May 7, 2009

(30) Foreign Application Priority Data

Nov. 1, 2007 (TW) ..... 96141223 A

(51) Int. Cl.
*G05F 1/00* (2006.01)

(52) U.S. Cl. ..... 323/217; 323/223; 323/224; 323/242; 323/265; 323/288

(58) Field of Classification Search ..... 323/217, 323/223, 224, 226, 237, 242, 263, 265, 268–273, 323/288

See application file for complete search history.

(56) References Cited

U.S. PATENT DOCUMENTS

| | | | | |
|---|---|---|---|---|
| 7,274,177 | B2 * | 9/2007 | Huang et al. | 323/277 |
| 2006/0214651 | A1 * | 9/2006 | Ke et al. | 323/311 |
| 2007/0200541 | A1 * | 8/2007 | Hachiya | 323/282 |
| 2009/0128109 | A1 * | 5/2009 | Brinkman | 323/282 |

* cited by examiner

*Primary Examiner*—Bao Q Vu
*Assistant Examiner*—Nguyen Tran
(74) *Attorney, Agent, or Firm*—Rosenberg, Klein & Lee

(57) ABSTRACT

A power supply includes a first switch to establish a first path to charge an output of the power supply by a voltage source, a second switch to establish a second path to discharge the output, and a third switch connected between the output and a capacitor. When to discharge the output, the third switch is turned on before the second switch turns on, to transfer a portion of energy on the output to the capacitor. When to charge the output, the third switch is turned on before the first switch turns on, to transfer a portion of the energy on the capacitor to the output.

12 Claims, 6 Drawing Sheets

POWER CONSUMPTION REDUCTION OF A POWER SUPPLY

FIELD OF THE INVENTION

The present invention is related generally to power supplies and, more particularly, to a circuit and method for power consumption reduction of a power supply.

BACKGROUND OF THE INVENTION

FIG. 1 is a diagram to show a conventional power supply 10 for supplying power to a gate driver of a liquid crystal display (LCD) system, which includes a transistor M1 connected between a voltage source VGH and an output VGHM, a transistor M2 connected between the output VGHM and a resistor RE having an end connected to a ground terminal GND, and a controller 122 to switch the transistors M1 and M2 to generate a voltage VGHM supplied to a power input of the LCD gate driver. Typically, the transistors M1 and M2 and the controller 122 are integrated in a same package 12. FIG. 2 is a waveform diagram of the voltage VGHM of the power supply 10 shown in FIG. 1. During the period from time t1 to time t2, the transistor M1 is on and the transistor M2 is off, so that the voltage source VGH charges the output VGHM to pull up the voltage VGHM to the level VGH. During the period from time t2 to time t3, the transistor M1 is off and the transistor M2 is on, so that energy is released from the output VGHM to the ground terminal GND and thereby decreasing the voltage VGHM.

However, with the increase of the LCD panel size, the loading of the power supply 10 is getting heavier, thereby increasing the energy required for charging to and discharging from the output VGHM, while the charging and discharging period of the power supply 10 is constant or may even become shorter. Therefore, higher discharge speed is required for the power supply 10 as the LCD panel size increases. Conventionally, smaller resistor RE is used to increase the discharge speed of the power supply 10. Unfortunately, this will increase the discharge current flowing through the resistor RE and thereby cause great heat generation and power consumption.

Therefore, it is desired a solution to reduce the power consumption of such power supplies.

SUMMARY OF THE INVENTION

An object of the present invention is directed to power consumption reduction of a power supply.

To reduce the power consumption, according to the present invention, a power supply includes a first switch connected between a voltage source and an output of the power supply, a second switch connected between the output and a ground terminal, and a third switch connected between the output and a capacitor. During a discharging period, the third switch is turned on to transfer energy from the output to the capacitor, and then the third switch is turned off and the second switch is turned on consecutively, to further discharge the output. During a charging period, the third switch is turned on to transfer energy from the capacitor to the output for rising up the voltage at the output to a certain level, and then the third switch is turned off and the first switch is turned on consecutively, to further charge the output by the voltage source.

In the power supply according to the present invention, a certain amount of energy is stored to the capacitor before discharging the output. Thus, when the second switch is on to discharge the output, the energy delivering through the second switch is reduced, and thereby the heat generated therefrom is reduced. Before charging the output, the energy stored on the capacitor is returned to the output for raising up the voltage at the output to a certain level, and thus when the voltage source charges the output, less energy is needed to raise up the voltage at the output to an expected level, thereby reducing the power consumption.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAIL DESCRIPTION OF THE INVENTION

Figure 1:
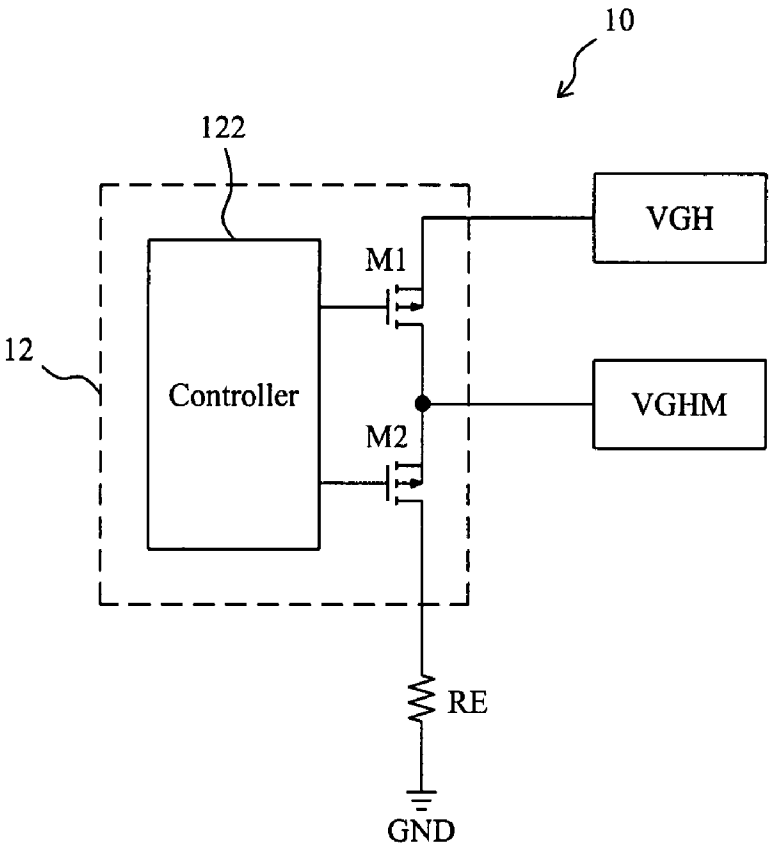
Fig. 1 Prior Art
FIG. 1 is a diagram to show a conventional power supply for supplying power to a LCD gate driver.
Figure 2:
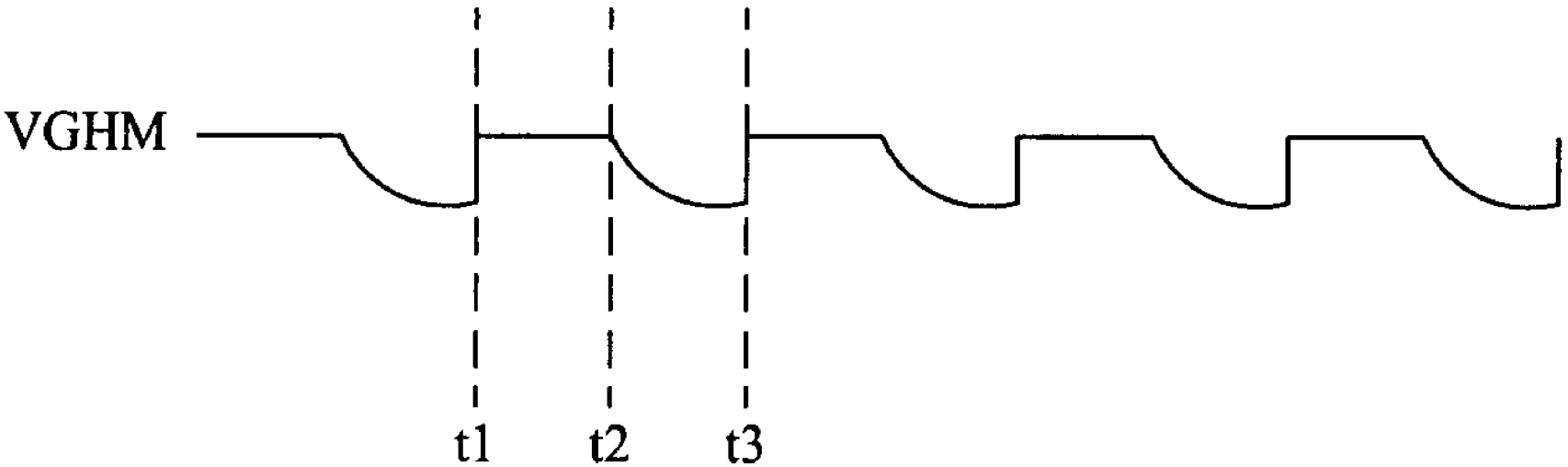
Fig. 2 Prior Art
FIG. 2 is a waveform diagram of the output voltage of the power supply shown in FIG. 1.
Figure 3:
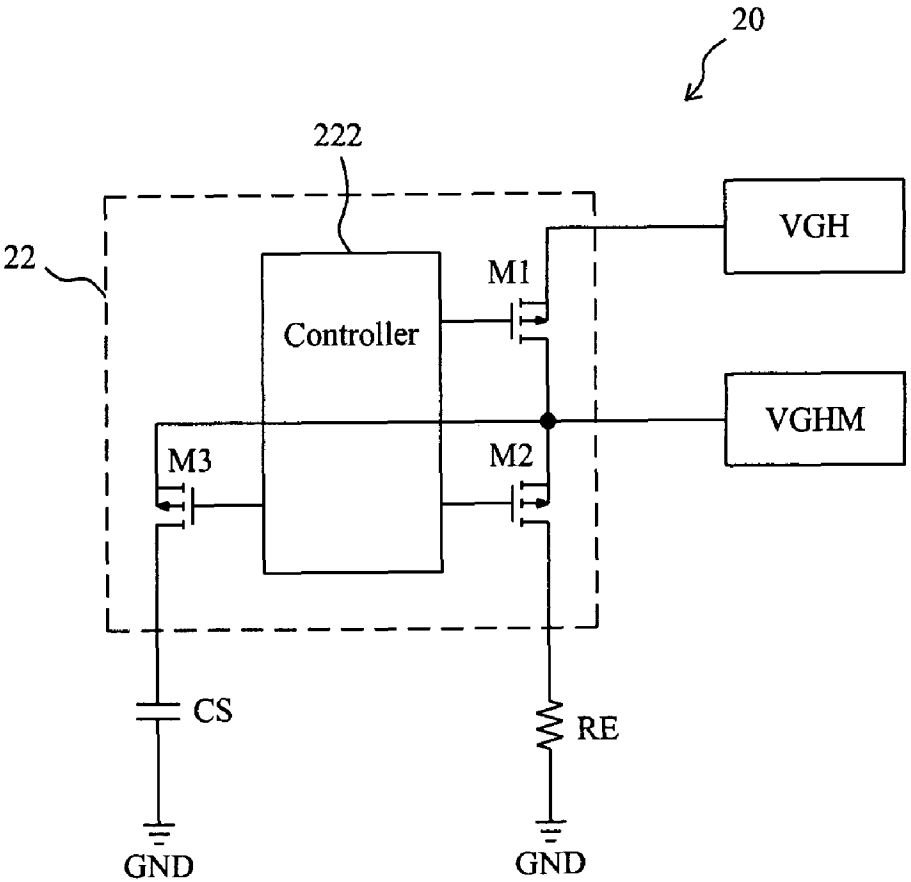
FIG. 3 is a first embodiment according to the present invention.
Figure 4:
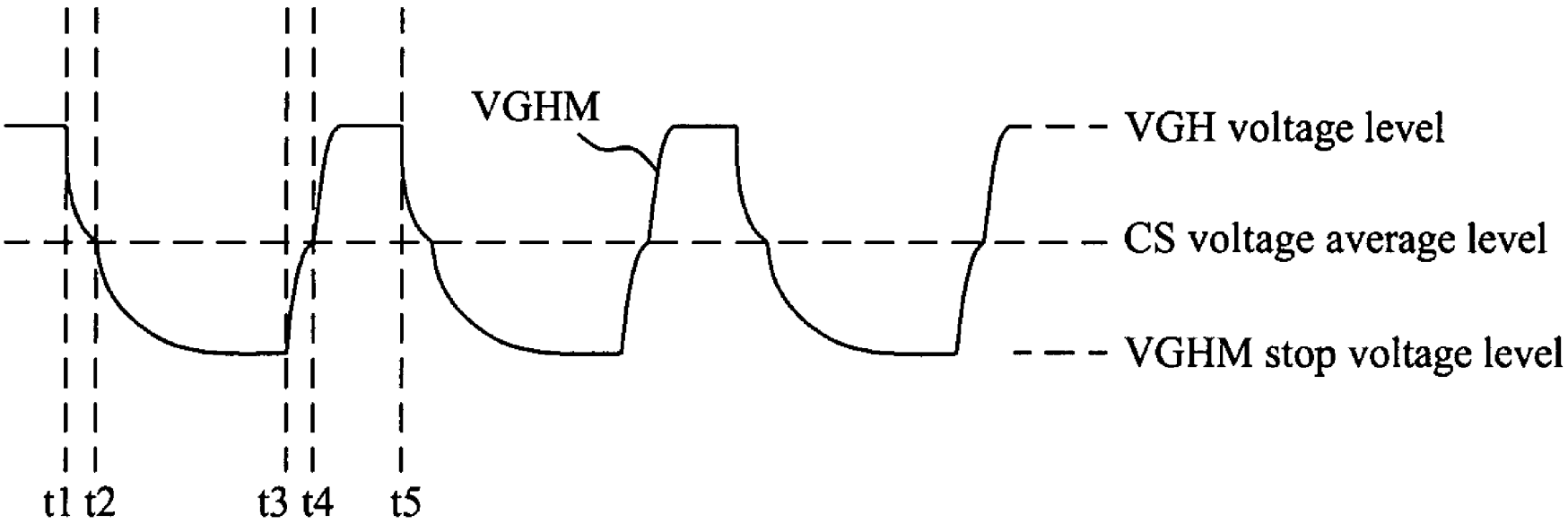
FIG. 4 is a waveform diagram of the output voltage of the power supply according to the present invention.

In a power supply 20 of FIG. 3 according to the present invention, a transistor M1 is connected between a voltage source VGH and an output VGHM, a transistor M2 is connected between the output VGHM and a resistor RE, a transistor M3 is connected between the output VGHM and a capacitor CS, each of the resistor RE and capacitor CS has a terminal connected to a ground terminal GND, and a controller 222 switches the transistors M1, M2 and M3. Preferably, the controller 222 and the transistors M1, M2 and M3 are all integrated in a same package 22. FIG. 4 is a waveform diagram of the output voltage VGHM of the power supply 20, to illustrate the operation of the power supply 20. In a discharging period of the power supply 20, for example from time t1 to time t3, during the period from time t1 to time t2, the controller 222 turns off the transistors M1 and M2 and turns on the transistor M3. In this case, because the voltage VGHM is higher than the voltage on the capacitor CS, the capacitor CS is charged by some energy from the output VGHM, and the voltage VGHM drops down a little accordingly. Then, during the period from time t2 to time t3, the controller 222 turns off the transistor M3 and turns on the transistor M2, so that the output VGHM discharges to the ground terminal GND. Thereafter, in the charging period from time t3 to time t5, during the period from time t3 to time t4, the transistor M2 is off and the transistor M3 is on, so that because the voltage VGHM is lower than the voltage on the capacitor CS, the output VGHM is charged by the energy stored on the capacitor CS with the energy stored on the capacitor CS and has its voltage raised up to a certain level. Then, during the period from time t4 to time t5, the transistor M3 is off and the transistor M1 is on, so that the output VGHM is further charged by the voltage source VGH and has its voltage risen to an expected level.

Figure 5:
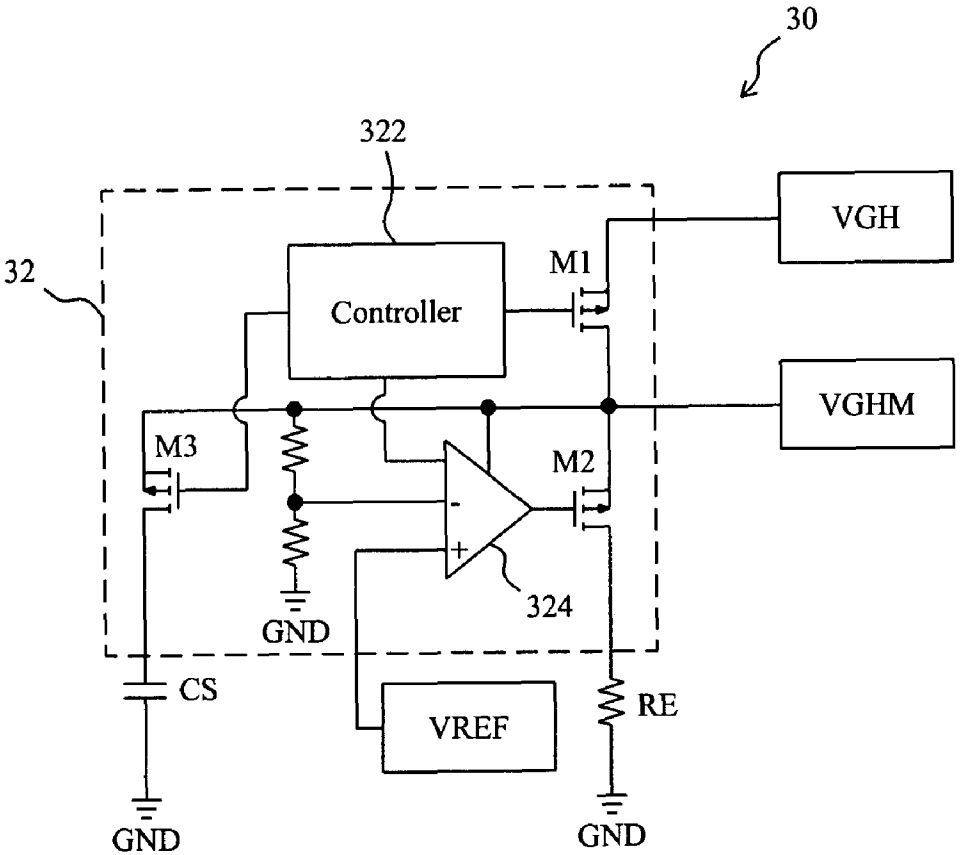
FIG. 5 is a second embodiment according to the present invention.

In the second power supply 30 of FIG. 5 according to the present invention, a transistor M1 is connected between a voltage source VGH and an output VGHM, a transistor M2 is connected between the output VGHM and a resistor RE, a transistor M3 is connected between the output VGHM and a capacitor CS, each of the resistor RE and capacitor CS has a terminal connected to a ground terminal GND, a controller 322 switches the transistors M1 and M3, and an operational amplifier 324 switches the transistor M2 according to the voltage VGMH and a reference voltage VREF during the discharging process of the output VGHM. Preferably, the controller 322, the operational amplifier 324 and the transistors M1, M2 and M3 are all integrated in a same package 32. The voltage VGHM of the power supply 30 varies as the waveform shown in FIG. 4. In the discharging period from time t1 to time t3, during the period from time t1 to time t2, the transistors M1 and M2 are both turned off and the transistor M3 is turned on, so that the capacitor CS is charged by some energy from the output VGHM since the voltage VGHM is higher than the voltage on the capacitor CS. Then, during the period from time t2 to time t3, the transistor M3 is turned off and the transistor M2 is turned on, so that the output VGHM is further discharged to the ground terminal GND. The transistor M2 will not be turned off unless the voltage VGHM is lower than the reference voltage VREF. In the charging period from time t3 to time t5, during the period from time t3 to time t4, the transistor M2 is off and the transistor M3 is on, so that the output VGHM is charged by the energy stored on the capacitor CS to raise up its voltage since the voltage on the capacitor CS is higher than the voltage VGHM. Then, during the period from time t4 to time t5, the transistor M3 is off and the transistor M1 is on, so that the output VGHM is further charged by the voltage source VGH to VGH.

Figure 6:
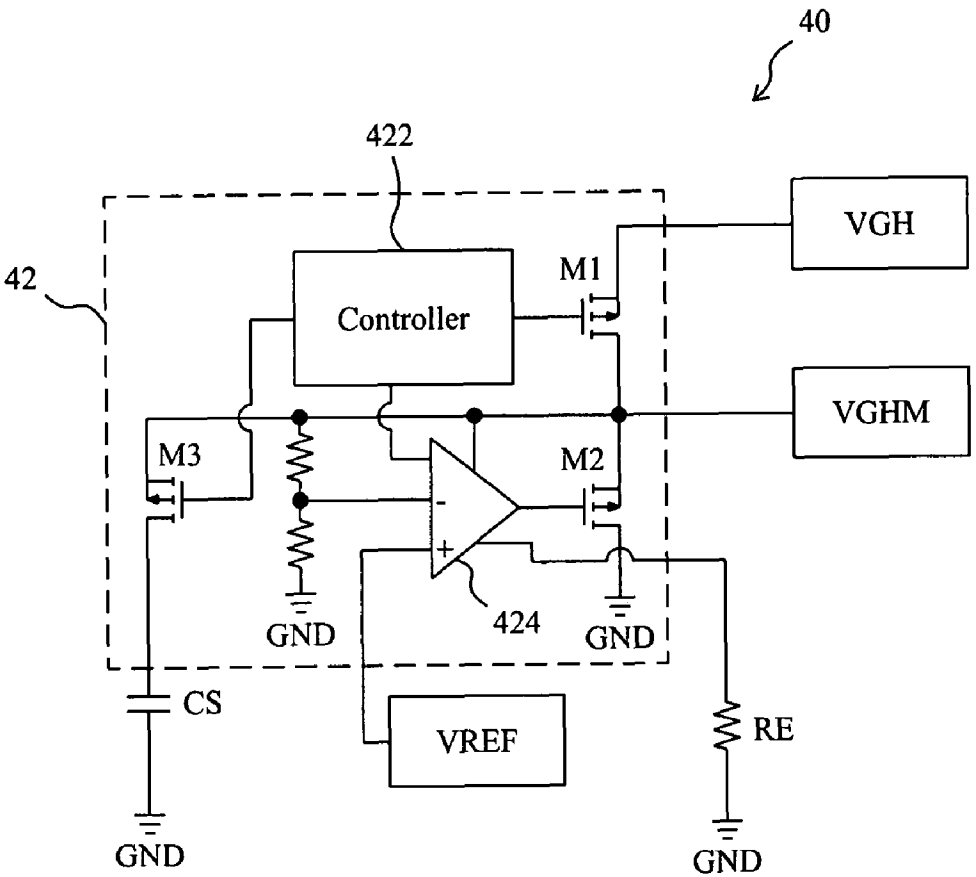
FIG. 6 is a third embodiment according to the present invention.

In the third power supply 40 of FIG. 6 according to the present invention, a transistor M1 is connected between a voltage source VGH and an output VGHM, a transistor M2 is connected between the output VGHM and a ground terminal GND, a transistor M3 is connected between the output VGHM and a capacitor CS, a controller 422 switches the transistors M1 and M3, and an operational amplifier 424 switches the transistor M2 during the discharging process of the output VGHM. The operational amplifier 424 will turn off the transistor M2 when the output VGHM is discharged to have its voltage below a reference voltage VREF, and may control the maximum discharging current flowing through the transistor M2 according to the setting by a resistor RE. Preferably, the controller 422, the operational amplifier 424 and the transistors M1, M2 and M3 are all integrated in a same package 42. The voltage VGHM of the power supply 40 varies as the waveform shown in FIG. 4. In the discharging period from time t1 to time t3, during the period from time t1 to time t2, the transistors M1 and M2 are turned off and the transistor M3 is turned on, so that the capacitor CS is charged by some energy from the output VGHM because the voltage VGHM is higher than the voltage on the capacitor CS in this case. Then, during the period from time t2 to time t3, the transistor M3 is turned off and the transistor M2 is turned on, so that the output VGHM is further discharged to the ground terminal GND. The transistor M2 will not be turned off unless the voltage VGHM is below than the reference voltage VREF. In the charging period from time t3 to time t5, during the period from time t3 to time t4, the transistor M2 is off and the transistor M3 is on, so that the output VGHM is charged by the energy stored on the capacitor CS because the voltage at the capacitor CS is higher than the voltage VGHM in this case. As a result, the voltage VGHM raises up to some level. Then, during the period from time t4 to time t5, the transistor M3 is off and the transistor M1 is on, so that the output VGHM is further charged by the voltage source VGH and has its voltage VGHM raised up to VGH.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A power supply comprising:

a first switch connected between a voltage source and an output of the power supply;

a second switch connected between the output and a ground terminal;

a capacitor; and a third switch connected between the output and the capacitor;

wherein a portion of energy on the output is stored to the capacitor before the output discharges to the ground terminal, and the output is charged by the energy stored on the capacitor before the output is charged by the voltage source.

2. The power supply of claim 1, wherein the voltage source charges the output when the first switch is on and the second and third switches are off, the output is discharged to the ground terminal when the second switch is on and the first and third switches are off, and the output is discharged or charged by the capacitor when the third switch is on and the first and second switches are off.

3. The power supply of claim 1, further comprising a controller to switch the first, second and third switches.

4. The power supply of claim 3, wherein the controller and the first, second and third switches are all integrated in a package.

5. The power supply of claim 1, further comprising:

a controller to switch the first and third switches; and an operational amplifier to switch the second switch according to a voltage at the output and a reference voltage.

6. The power supply of claim 5, further comprising a resistor connected to the operational amplifier to limit a discharging current flowing through the second switch.

7. The power supply of claim 5, wherein the controller, the operational amplifier and the first, second and third switches are all integrated in a package.

8. A method for power consumption reduction of a power supply including a first switch to establish a first path to charge an output of the power supply by a voltage source, a second switch to establish a second path to discharge the output, and a third switch connected between the output and a capacitor, the method comprising the steps of:

transferring a portion of energy on the output to charge the capacitor by turning on the third switch before the second switch turns on during a discharging period of the output; and delivering a portion of the energy stored on the capacitor to the output to charge the output before the first switch turns on during a charging period of the output.

9. The method of claim 8, wherein the second switch is switched according to a voltage on the output and a reference voltage.

10. The method of claim 9, further comprising limiting the discharging current flowing through the second switch.

11. A power supply comprising:

a first switch connected between a voltage source and an output of the power supply for coupling the voltage source to the output of the power supply during a portion of a charge time period;

a second switch coupled between the output of the power supply and a reference potential for coupling the output of the power supply to the reference potential during a portion of a discharge time period;

a capacitor;

a third switch connected between the output of the power supply and the capacitor for increasing a speed of discharge of the output of the power supply and supplying energy recovered from the discharge to the output of the power supply back to the output of the power supply during the charge time period; and a control circuit coupled to each of the first, second and third switches for controlling respective operation thereof, the control circuit switching the third switch on and then off preceding switching on the second switch to charge the capacitor while beginning a rapid discharge of the output of the power supply, and the control circuit switching the third switch on and then off preceding switching on the first switch to transfer a charge stored on the capacitor to the output of the power supply.

12. The power supply of claim 11, wherein the control circuit includes:

a controller respectively coupled to each of the first and third switches for controlling the respective operation thereof; and an operational amplifier having an output coupled to the second switch and inputs respectively coupled to the controller, the output of the power supply and a reference voltage, the second switch being switched off responsive to a voltage input from the output of the power supply being less than the reference voltage.

* * * * *